US007719439B2

(12) United States Patent
Pratt et al.

(10) Patent No.: US 7,719,439 B2
(45) Date of Patent: May 18, 2010

(54) ROTARY PULSER

(75) Inventors: F. Dale Pratt, Calgary (CA); Kenneth A. Lambe, Calgary (CA)

(73) Assignee: Newsco Directional and Horizontal Drilling Services Inc., Calgary, Alberta (CA)

( * ) Notice: Subject to any disclaimer, the term of this patent is extended or adjusted under 35 U.S.C. 154(b) by 526 days.

(21) Appl. No.: 11/479,412

(22) Filed: Jun. 30, 2006

(65) Prior Publication Data

US 2008/0002525 A1 Jan. 3, 2008

(51) Int. Cl.
*G01V 3/00* (2006.01)

(52) U.S. Cl. ..... 340/855.4; 340/855.5; 340/854.6; 367/84; 175/40; 175/45

(58) Field of Classification Search ..... 175/40, 175/45; 340/854.3, 855.4, 856.4; 367/84
See application file for complete search history.

(56) References Cited

U.S. PATENT DOCUMENTS

| | | | | |
|---|---|---|---|---|
| 3,488,030 | A | 1/1970 | Hulme et al. | |
| 3,949,354 | A | 4/1976 | Claycomb | |
| 3,958,217 | A | 5/1976 | Spinnler | |
| 4,216,536 | A | 8/1980 | More | |
| 4,367,794 | A | 1/1983 | Bednar et al. | |
| 4,386,422 | A | 5/1983 | Mumby et al. | |
| 4,401,134 | A | 8/1983 | Dailey | |
| 4,515,225 | A | 5/1985 | Dailey | |
| 4,550,392 | A | 10/1985 | Mumby | |
| 4,593,881 | A | 6/1986 | Yoshino | |
| 4,699,352 | A | 10/1987 | Mumby | |
| 4,785,300 | A | 11/1988 | Chin et al. | |
| 4,825,421 | A | 4/1989 | Jeter | |
| 4,901,290 | A | 2/1990 | Feld et al. | |
| 5,103,430 | A | 4/1992 | Jeter et al. | |
| 5,115,415 | A | 5/1992 | Mumby et al. | |
| 5,117,398 | A | 5/1992 | Jeter | |
| 5,182,731 | A | 1/1993 | Hoelscher et al. | |
| 5,237,540 | A * | 8/1993 | Malone | 367/81 |
| 5,333,686 | A | 8/1994 | Vaughan et al. | |
| 5,586,084 | A | 12/1996 | Barron et al. | |
| 5,660,238 | A | 8/1997 | Earl et al. | |

(Continued)

FOREIGN PATENT DOCUMENTS

| | | |
|---|---|---|
| CA | 2195722 | 1/1998 |

(Continued)

OTHER PUBLICATIONS

Protest under 37 CFR 1.291 in Respect of U.S. Appl. No. 11/479,412, mailed Apr. 20, 2009, 20 pages.

(Continued)

*Primary Examiner*—Timothy Edwards, Jr.
(74) *Attorney, Agent, or Firm*—Blakely, Sokoloff, Taylor & Zafman LLP.

(57) ABSTRACT

An improved energy efficient intelligent rotary pulser for generating a mud pulse in a MWD (measurement while drilling) application. In the rotary pulser, a control circuit activates a brushless motor that rotates a windowed restrictor relative to a fixed housing to act as a shutter and window respectively. Opening of the windowed restrictor allows generally unrestricted mud flow. Closing of the windowed restrictor generally restricts mud flow. The windowed restrictor is powered both in opening and closing operations by the motor.

5 Claims, 5 Drawing Sheets

U.S. PATENT DOCUMENTS

| | | | | |
|---|---|---|---|---|
| 5,740,127 | A | 4/1998 | Van Steenwyk et al. | |
| 5,787,052 | A | 7/1998 | Gardner et al. | |
| 6,002,643 | A | 12/1999 | Tchakarov et al. | |
| 6,014,000 | A | 1/2000 | Gutierrez | |
| 6,016,288 | A | 1/2000 | Frith | |
| 6,044,857 | A | 4/2000 | Stege | |
| 6,088,294 | A * | 7/2000 | Leggett et al. | 367/25 |
| 6,097,310 | A | 8/2000 | Harrell et al. | |
| 6,636,159 | B1 | 10/2003 | Winnacker | |
| 6,714,138 | B1 * | 3/2004 | Turner et al. | 340/854.3 |
| 6,850,463 | B2 | 2/2005 | Winnacker | |
| 6,932,319 | B2 | 8/2005 | Kowalski | |
| 7,327,634 | B2 | 2/2008 | Perry et al. | |
| 7,468,679 | B2 | 12/2008 | Feluch | |
| 2004/0027917 | A1 | 2/2004 | Winnacker | |
| 2005/0028522 | A1 | 2/2005 | Fripp et al. | |
| 2006/0034154 | A1 * | 2/2006 | Perry et al. | 367/84 |
| 2006/0118334 | A1 * | 6/2006 | Hahn et al. | 175/48 |
| 2007/0056771 | A1 * | 3/2007 | Gopalan et al. | 175/40 |

FOREIGN PATENT DOCUMENTS

| | | |
|---|---|---|
| CA | 2237017 | 2/1999 |
| CA | 2259819 | 8/1999 |
| CA | 2370987 | 8/2002 |
| CA | 2440815 | 9/2002 |
| CA | 2450459 | 12/2002 |
| CA | 2436069 | 2/2004 |
| CA | 2315981 | 6/2006 |
| DE | 19627719 | 1/1998 |
| GB | 2289117 | 8/1995 |

OTHER PUBLICATIONS

"Small Brushless DC Motor Technology Construction and Advantages", prior to Apr. 6, 2004, pp. 28-29.

Motion & Control NSK, "Miniature Precision Rolling Ball Screw RMA, RMS Series", 1996, 3 pages.

Canadian Intellectual Property Office, Protest to CA 2,463,354 (to which related U.S. Appl. No. 11/101,033 claims priority), Title: Intelligent Efficient Servo-Actuator for a Downhole Pulser, Owner: Newsco Directional and Horizontal Drilling Services Inc, Feb. 3, 2009, 23 pages.

Supporting Documents for Protest to CA 2,463,354 (to which related U.S. Appl. No. 11/101,033 claims priority), Excerpts from the Public File History of US 6,016,288, pp. 1, 3 & 6 and Exhibit 5 of "The Bob Fournet Company's Supplemental Responses to Defendant's First Set of Interrogatories" and pp. 3 and 4 of "Defendant's Original Answer and Counterclaims to First Supplemental and Amending Petition of the Bob Fournet Company", Jan. 18, 2000, 85 pages.

Canadian Office Action, CA Application No. 2,463,354 (to which related U.S. Appl. No. 11/101,033 claims priority); mailing date: May 25, 2006, 4 pages.

Letter to US Patent and Trademark Office from V. Allan, Geolink, Aberdeen, Scotland, UK regarding related U.S. Appl. No. 11/101,033, Nov. 30, 2007, 3 pages.

Protest under 37 CFR 1.291 regarding related U.S. Appl. No. 11/101,033 from D. Doak Horne of Growling Lafleur Henderson LLP with transmittal papers and references, Oct. 15, 2008, 106 pages.

* cited by examiner

ROTARY PULSER

FIELD OF THE INVENTION

The present invention relates generally to a telemetry system, and in particular to a measurement while drilling (MWD) system. More particularly, the present invention relates to an actuator for a downhole mud pulser for sending information from downhole to surface.

BACKGROUND OF THE INVENTION

The desirability and effectiveness of well logging systems where information is sensed in the well hole and transmitted to the surface through mud pulse telemetry has long been recognized. Mud pulse telemetry systems provide the driller at the surface with means for quickly determining various kinds of downhole information, most particularly information about the location, orientation and direction of the drill string at the bottom of the well in a directional drilling operation. During normal drilling operations, a continuous column of mud is circulating within the drill string from the surface of the well to the drilling bit at the bottom of the well and then back to the surface. Mud pulse telemetry repeatedly restricts the flow of mud to propagate signals through the mud upward to the surface, thereby providing a very fast communication link between the drill bit and the surface. Depending on the type of drilling fluid used, the velocity may vary between approximately 3000 and 5000 feet per second.

A telemetry system may be lowered on a wireline located within the drill string, but is usually formed as an integral part of a special drill collar inserted into the drill string near the drilling bit. The basic operational concept of mud pulse telemetry is to intermittently restrict the flow of mud as it passes through a downhole telemetry valve, thereby creating a pressure pulse in the mud stream that travels to the surface of the well. The information sensed by instrumentation in the vicinity of the drilling bit is encoded into a digital formatted signal and is transmitted by instructions to pulse the mud by intermittently actuating the telemetry valve, which restricts the mud flow in the drill string, thereby transmitting pulses to the well surface where the pulses are detected and transformed into electrical signals which can be decoded and processed to reveal transmitted information.

Representative examples of previous mud pulse telemetry systems may be found in U.S. Pat. Nos. 3,949,354; 3,958,217; 4,216,536; 4,401,134; and 4,515,225.

Representative samples of mud pulse generators may be found in U.S. Pat. Nos. 4,386,422; 4,699,352; 5,103,430; and 5,787,052.

A telemetry system capable of performing the desired function with minimal control energy is desirable, since the systems are typically powered by finite-storage batteries. One such example is found in U.S. Pat. No. 5,333,686, which describes a mud pulser having a main valve biased against a narrowed portion of the mud flowpath to restrict the flow of mud, with periodic actuation of the main valve to allow mud to temporarily flow freely within the flowpath. The main valve is actuated by a pilot valve that can be moved with minimal force. The pilot valve additionally provides for pressure equalization, thereby increasing the life of downhole batteries.

Another example of an energy efficient mud pulser is described in U.S. Pat. No. 6,016,288, the mud pulser having a DC motor electrically powered to drive a planetary gear which in turn powers a threaded drive shaft, mounted in a bearing assembly to rotate a ball nut lead screw. The rotating threaded shaft lifts the lead screw, which is attached to the pilot valve.

Solenoid-type pulser actuators have also been used to actuate the main pulser valve, however, there are many problems with such a system. The use of a spring to bias the solenoid requires the actuator (servo) valve to overcome the force of the spring (about 6 pounds) and of the mud prior to actuating the main valve. A typical solenoid driven actuator valve is capable of exerting only 11 pounds of pressure, leaving only 5 pounds of pressure to actuate the pulser assembly. Under drilling conditions requiring higher than normal mud flow, the limited pressures exerted by the solenoid may be unable to overcome both the pressure of the return spring and the increased pressure of the flowing mud, resulting in a failure to open the servo-valve, resulting in the main valve remaining in a position in which mud flow is not restricted, and therefore failing to communicate useful information to the surface.

A further problem with the use of a solenoid to actuate the pulser assembly is the limited speed of response and recovery that is typical of solenoid systems. Following application of a current to a solenoid, there is a recovery period during which the magnetic field decays to a point at which it can be overcome by the force of the solenoid's own return spring to close the servo-valve. This delay results in a maximum data rate (pulse width) of approximately 0.8 seconds/pulse, limiting the application of the technology.

Moreover, the linear alignment of the solenoid must be exactly tuned (i.e. the magnetic shaft must be precisely positioned within the coil) in order to keep the actuator's power characteristics within a reliable operating range. Therefore, inclusion of a solenoid within the tool adds complexity to the process of assembling and repairing the pulser actuator, and impairs the overall operability and reliability of the system.

Existing tools are also prone to jamming due to accumulation of debris, reducing the range of motion of the pilot valve. Particularly when combined with conditions of high mud flow, the power of the solenoid is unable to clear the jam, and the tool is rendered non-functional. The tool must then be brought to the surface for service.

Stepper motors have been used in mud pulsing systems, specifically, in negative pulse systems (see for example U.S. Pat. No. 5,115,415). The use of a stepper motor to directly control the main pulse valve, however, requires a large amount of electrical power, possibly requiring a turbine generator to supply adequate power to operate the system for any length of time downhole.

Repair of previous pulsers has been an as yet unresolved difficulty. Typically, the entire tool has been contained within one housing, making access and replacement of small parts difficult and time-consuming. Furthermore, a bellows seal within the servo-poppet has typically been the only barrier between the mud flowing past the pilot valve's poppet and the pressurized oil contained within the servo-valve actuating tool, which is required to equalize the hydrostatic pressure of the downhole mud with the tool's internal spaces. Therefore, in order to dissemble the tool for repair, the bellows seal had to be removed, causing the integrity of the pressurized oil chamber to be lost at each repair.

Furthermore, a key area of failure of MWD pulser drivers has been the failure of the bellows seal around the servo-valve activating shaft, which separates the drilling mud from the internal oil. In existing systems, the addition of a second seal is not feasible, particularly in servo-drivers in which the servo-valve is closed by a spring due to the limited force which may be exerted by the spring, which is in turn limited by the available force of the solenoid, and cannot overcome the friction or drag of an additional static/dynamic linear seal.

It remains desirable within the art to provide a pulse generator that has an energy efficiency sufficient to operate reliably and to adapt to a variety of hostile downhole conditions, has reduced susceptibility to jamming by debris, and is simpler to repair than previous systems.

SUMMARY OF THE INVENTION

It is an object of the present invention to obviate or mitigate at least one disadvantage of previous mud pulsers and pulse generators.

In a first aspect, the present invention provides a downhole measurement-while-drilling rotary pulser having a windowed restrictor movable between an open position which permits mud flow through a fixed housing having a flow passage and a restricted position which restricts mud flow through the fixed housing having a flow passage, the windowed restrictor powered between the open position and the restricted position by a reversible electric motor.

The windowed restrictor is preferably movable between the open position and the restricted position in a reciprocating rotary motion relative to the fixed housing. Preferably, the fixed housing is held stationary and the windowed restrictor is rotatable, driven in rotation by the motor.

Preferably the rotary pulse includes a controller for controlling the electric motor. The controller may be adapted to sense the position of the windowed restrictor relative to the fixed housing and/or the absolute position of the windowed restrictor.

Preferably the position of the windowed restrictor is sensed when the mud flow through the flow passage is restricted, and wherein the amount and direction of rotations of the motor from that position are counted and stored by the controller. Preferably, the sensed position of the windowed restrictor is calibrated as the fully closed position of the windowed restrictor in controlling the windowed restrictor's travel during operation to avoid excess collision or frictional wear between the windowed restrictor and the windowed restrictor stop. Preferably the controller senses the position of the windowed restrictor by sensing whether movement of the windowed restrictor is impeded, and wherein the controller counts the number of rotations of the motor until the windowed restrictor is impeded and compares the number of rotations to an expected number of rotations to determine the position of the windowed restrictor with respect to the fixed housing. Preferably, the expected number of rotations is preset to allow a predetermined rate of mud flow past the windowed restrictor when the windowed restrictor is moved away from the fixed housing by the preset expected number of rotations.

Preferably, the controller includes a debris clearing command that is initiated when the number of rotations counted is not equal to the expected number of rotations. Preferably, the debris clearing command causes the motor to reciprocate the windowed restrictor to dislodge any debris present between the windowed restrictor and the fixed housing.

In a further aspect, the present invention provides a method for causing the generation of a pressure pulse in drilling mud by a controlled windowed restrictor valve including the steps of powering a rotary pulser windowed restrictor valve in a first direction using a rotary motor such that drilling mud is permitted to flow past a fixed housing; and powering the windowed restrictor in a second direction using the rotary motor such that drilling mud flow past the fixed housing is restricted, wherein the pressure pulse is generated.

Preferably, the power flow to the motor may be cut or interrupted to hold the windowed restrictor in a particular position within its range of motion to tailor the pressure and duration characteristics of a mud pulse.

In a further aspect, the present invention provides a controller for use with a downhole measurement-while-drilling rotary pulser, the controller having a sensor, memory, control circuitry, and an operator interface.

Preferably, the sensor is a mud flow sensor, pressure sensor, temperature sensor, rotation-step counter, position sensor, velocity sensor, current level sensor, battery voltage sensor, timer, or error monitor. Preferably, the memory is adapted to store time-stamped or counted sensed events together with an event-type indication. Preferably, the control circuitry is programmable to cause an action within the actuator responsive to a sensed event, a time, an elapsed time, a series of sensed events, or any combination thereof. Preferably, the operator interface provides information from memory to the operator. Preferably, the operator interface allows an operator to alter the programming of the control circuitry.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

The present invention relates to an apparatus and method for actuating a mud pulser telemetry system used during well-drilling or well logging operations. The present apparatus allows a pulser valve to be powered both in opening (e.g. to allow generally unrestricted flow) and in closing (e.g. to generally restrict flow,) and does not rely on a solenoid system.

The powered opening and closing of a windowed restrictor results in various functional and economic advantages, including the ability to clear debris from the restricted portion of the mud flowpath, and faster data rates due to elimination of inherent operating delays in the solenoid systems of previous tools, with the end result of providing a pulser driver which consumes a minimal amount of power (e.g. DC or AC electricity) while providing more force with which to drive the windowed restrictor in each direction. Therefore, the pulser remains functional at a comprehensive range of downhole drilling conditions.

Furthermore, in the embodiment shown in the Figures, the present device is designed to have several independent, interconnected housings, and employs a double seal between the oil compartment and the drilling mud, which simplifies assembly and repair of the tool. The assembly/disassembly is simplified to reduce repair turnaround time by using modular components.

Additionally, the use of a brushless motor, electric load sensors, and control circuitry in a powered-both-directions valve system allows for self-calibration of the tool and self-diagnosis and error correction unavailable in other systems.

Communication of information to the well surface is accomplished by encoded signals, which are translated to produce pressure changes in the downward flow of the pressurized drilling mud. It is recognized that although the drilling fluid is generally referred to as mud, other drilling fluids are also suitable for use with the present invention, as is well known in the art.

With reference to the Figures, the rotary pulser 10 of the present invention generally includes a plurality of serially interconnected housings 20, 30, 40, 50, 60, 70, and 80, an electrical connector 90, and a controller 100 for controlling the operation of the rotary pulser 10.

Figure 1A:
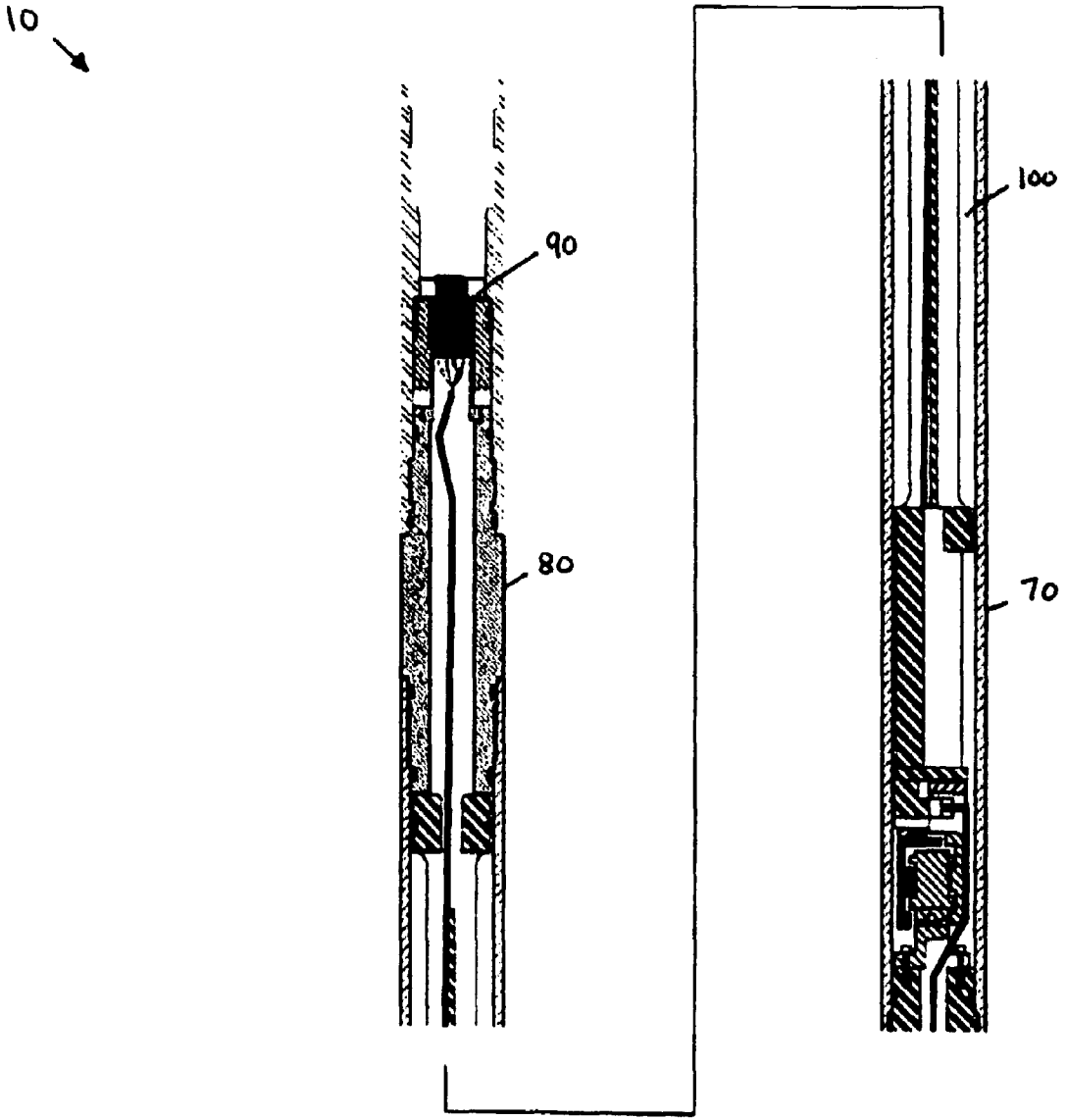
FIGS. 1A and 1B are longitudinal cross sectional views of the upper and lower portions of an embodiment of the mud pulser of the present invention, depicting a windowed restrictor in a restricted position.
Figure 1B:
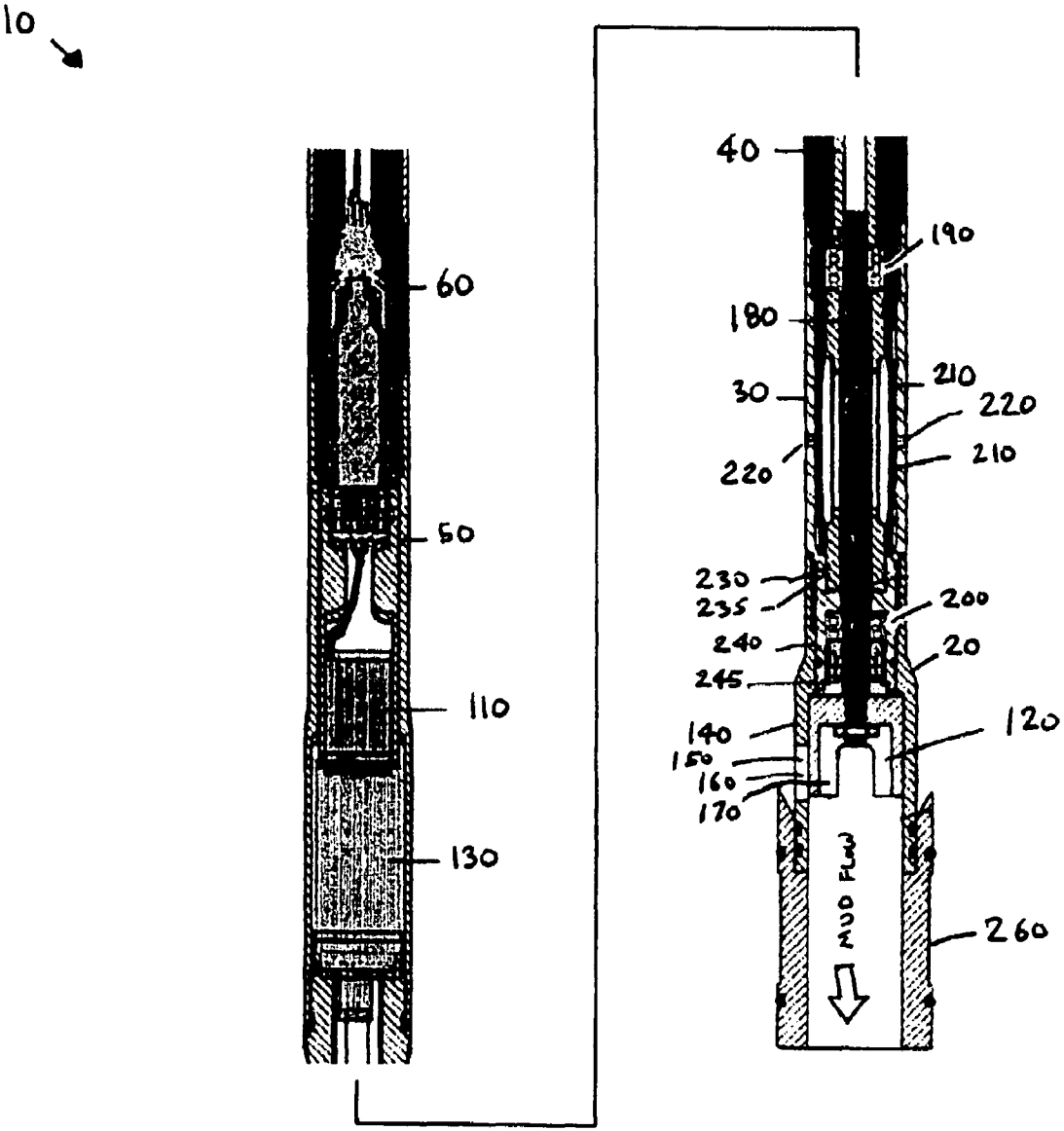

A preferred embodiment includes a motor 110, such as a brushless motor, AC motor, DC motor, 3 phase motor etc., which may be monitored and controlled by the controller 100, the rotary movement of the motor 110 being converted into rotary movement of a windowed restrictor 120 through a rotary gear reduction system 130, thereby moving the windowed restrictor 120 between an open position (see FIG. 2*b*) and a restricted position (see FIG. 1*b*). Preferably, the windowed restrictor 120 is movable, as in a rotor. The windowed restrictor 120 functionally cooperates with a fixed housing 140. Preferably, the fixed housing 140 is static, as in a stator. The fixed housing 140 may include a window 150 forming a flow passage 160. The windowed restrictor 120 may include a shutter 170. The shutter 170 may be adapted to substantially block the flow passage 160 when the windowed restrictor 120 is in the restricted position, and substantially open the flow passage 160 when the windowed restrictor 120 is in the open position.

Mechanical System

The rotary gear reduction system 130 is used to translate the torque from the motor 110 into rotary movement of the windowed restrictor 120, which is preferably a series of gear reductions through gear and pinion or worm gear type gear reductions. The rotary gear reduction system 130 may have a gear reduction generally in the ranges of 10:1, 100:1, or 1000:1. The rotary gear reduction system 130 includes seals which serve to isolate the rotating mechanism from the operating fluids.

In the embodiment pictured in FIGS. 1A and 1B, the motor 110, is electrically powered through an electrical connection 90, by a power source (not shown), such as batteries. When activated, the motor 110 rotates the rotary gear reduction system 130, causing rotation of an output shaft 180, which is operatively connected with the windowed restrictor 120. The output shaft 180 may be supported by bearings 190 and 200.

The output shaft 180 is surrounded by lubricating fluid, which must be pressurized against the downhole hydrostatic pressure. As shown, a pressure compensator in the form of a membrane or bellows 210 allows reservoir fluid to substantially equalize the pressure via a port 220. The pressure compensator may be a membrane, bellows, piston type or other type known in the industry. Seals 230, 235, 240, and 245 maintain the integrity of the lubrication chamber during operation and during replacement of the membrane or bellows 210 during maintenance.

In a preferred embodiment, the construction of the rotary pulser 10 allows a significant number of downhole clogs to be easily cleared, as described below (a clog being an event where debris in the mud may interfere with the windowed restrictor 120 and impede the capability of the windowed restrictor 120 from substantially blocking the window 150 and interfering with the flow passage 160, therefore reducing the ability of the rotary pulser 10 to produce a distinct or sharp pressure pulse in the mud). The serially interconnected housing design allows simplified and reduced repair time of the tool when necessary.

The windowed restrictor 120 and/or at least a portion of the fixed housing 140 are preferably composed of a wear resistant material or coated with a wear resistant material such as tungsten carbide or ceramic to increase the efficiency of the tool and to reduce maintenance of the tool, and is preferably replaceable.

The windowed restrictor 120 preferably comprises a plurality of shutters 170 which correspond to a plurality of windows 150 within the fixed housing 140. Most preferably, the windowed restrictor 120 includes a set of three shutters 170 spaced apart by 120° to correspond to three windows 150 spaced apart by 120° within the fixed housing 140. Preferably, the windows 150 provide a relatively large flow are to allow relatively large debris to flow unimpeded through the windows 150 and to reduce velocity/abrasion related "wash" or wear of components.

Preferably, at least a portion of an edge or edges of the shutter 170 (associated with the windowed restrictor 120) and/or at least a portion of an edge or edges of the window 150 (associated with the fixed housing 140) may be beveled, chamfered, or tapered, or otherwise channeled to adjust the flow characteristics and/or reduce wear.

Preferably, the windowed restrictor 120 is located towards a bottom end of the rotary pulser 10.

Preferably, the mud flow is generally radially inwards (e.g. from outside to center) to match the natural flow of mud, eliminating the apparatus associated "center out" type pulsers that utilize additional flow channeling to take at least a portion of the mud flow naturally occurring outside the tool, channel the mud into a central portion of a tool, and then pass it through the pulser's valve in the central portion of the tool (i.e. center-out), and then release the mud back to the annulus around the tool. In the present invention, abrasion or "wash" is reduced due to the much improved flow path. Decreased turbulence may also provide sharper pulse-edge characteristics in the mud's flow.

Operation

When restriction of mud flow through the rotary pulser 10 (i.e. to generate a positive pressure pulse), the motor 110 will be activated by the controller 100 in the direction to move the windowed restrictor 120 into the restricted position (See FIG. 1*b*). The current-consuming portion of the circuit is then shut down until a further signal is received from the controller 100. The lack of current to the motor 110 results in the motor 110 being immovable and therefore acting as a brake to prevent further movement of the windowed restrictor 120 until further activation of the motor 110.

Figure 2A:
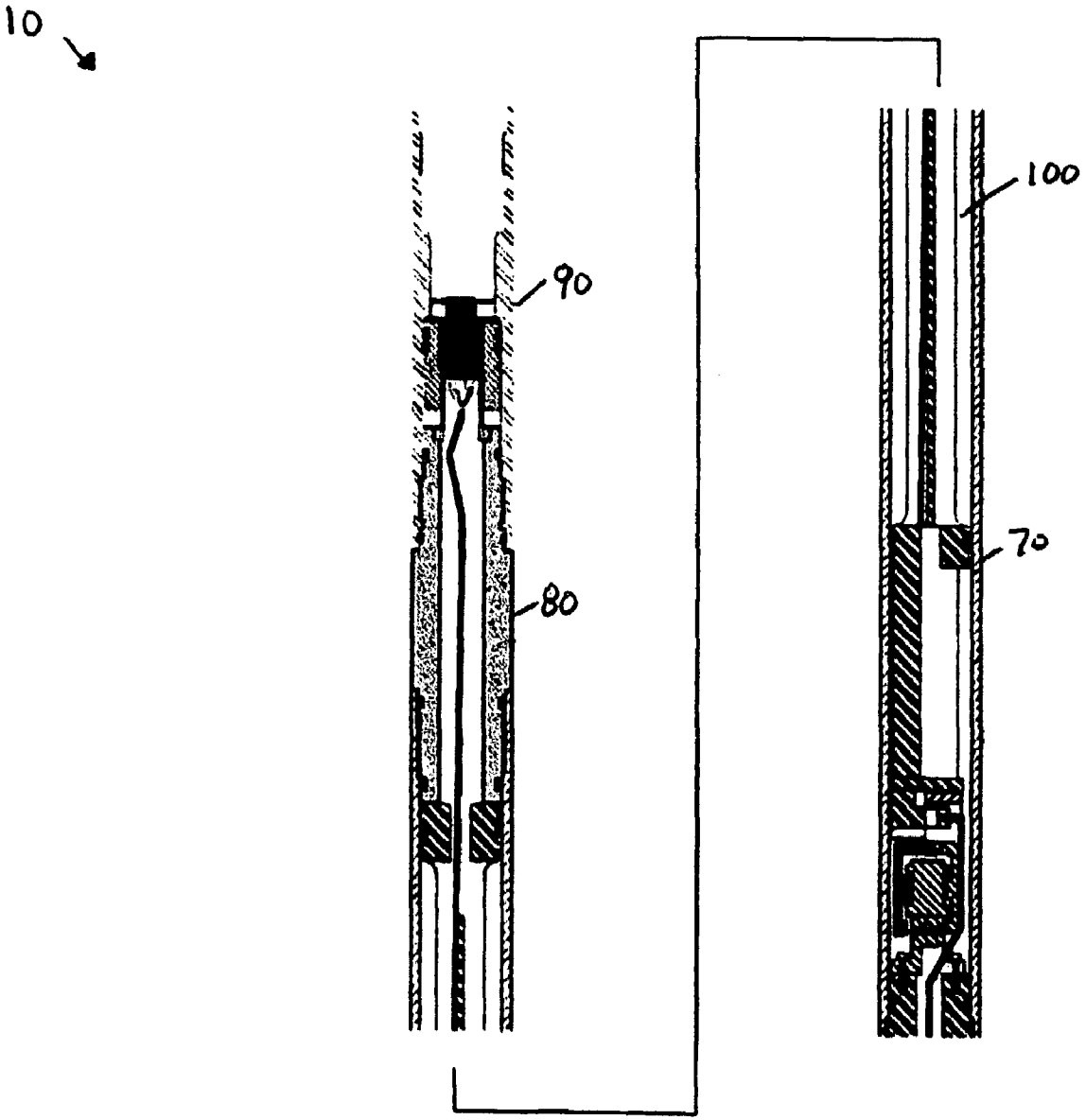
FIGS. 2A and 2B are a longitudinal cross sectional view of the upper and lower portions of an embodiment of the mud pulser of the present invention, depicting a windowed restrictor in an open position.
Figure 2B:
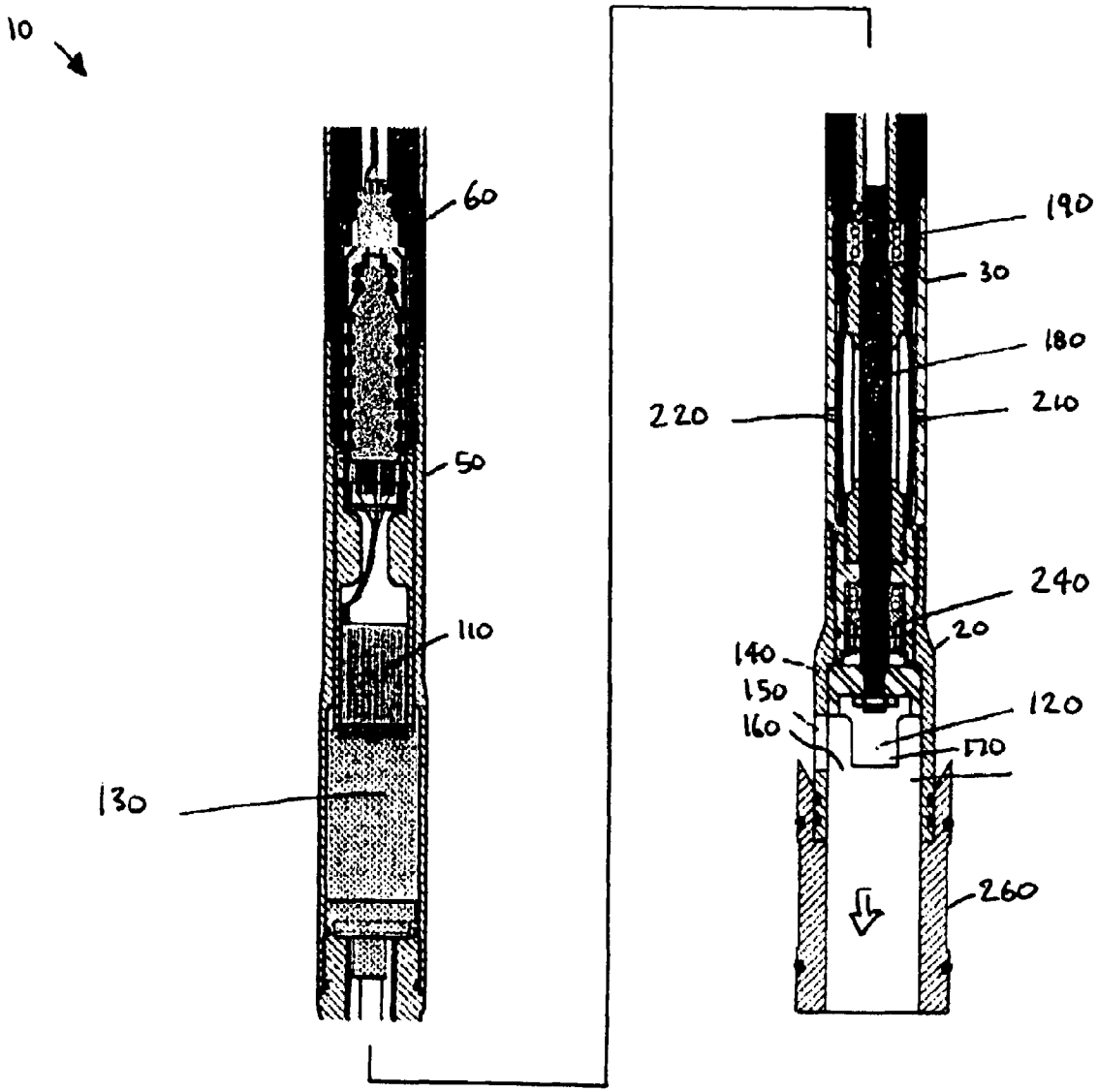
Figure 3:
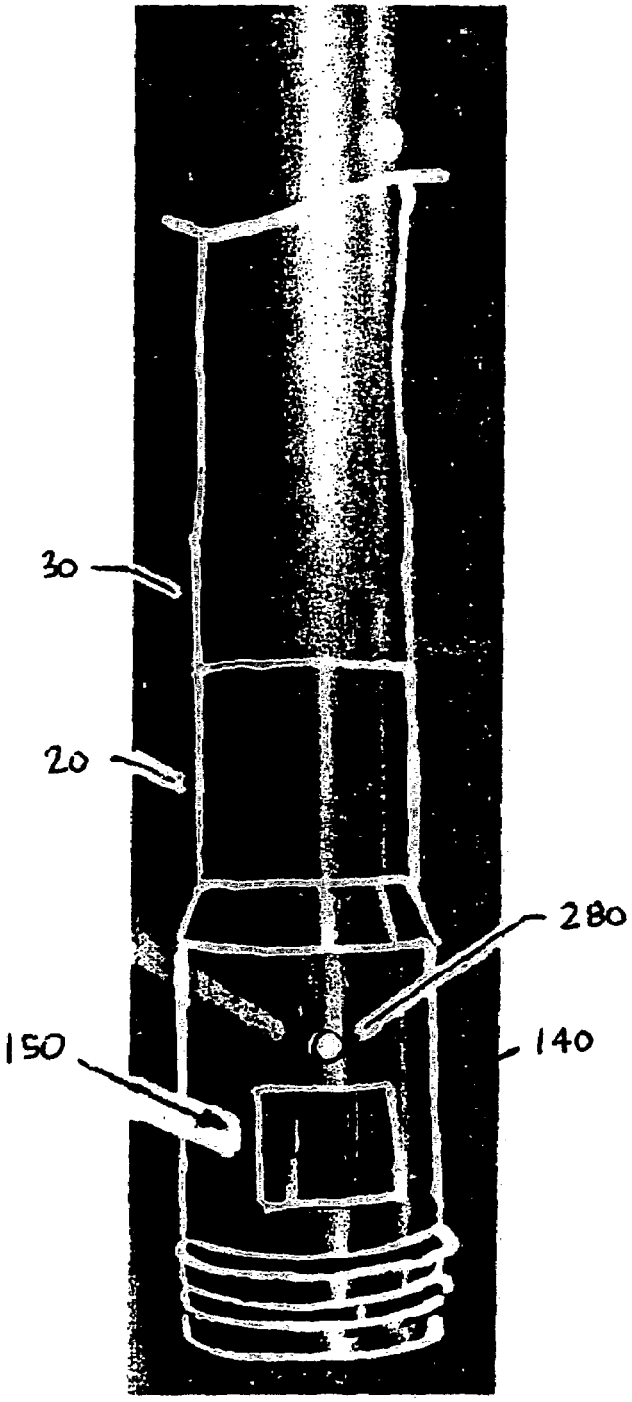
FIG. 3 is a fixed housing of the present invention.
Figure 4:
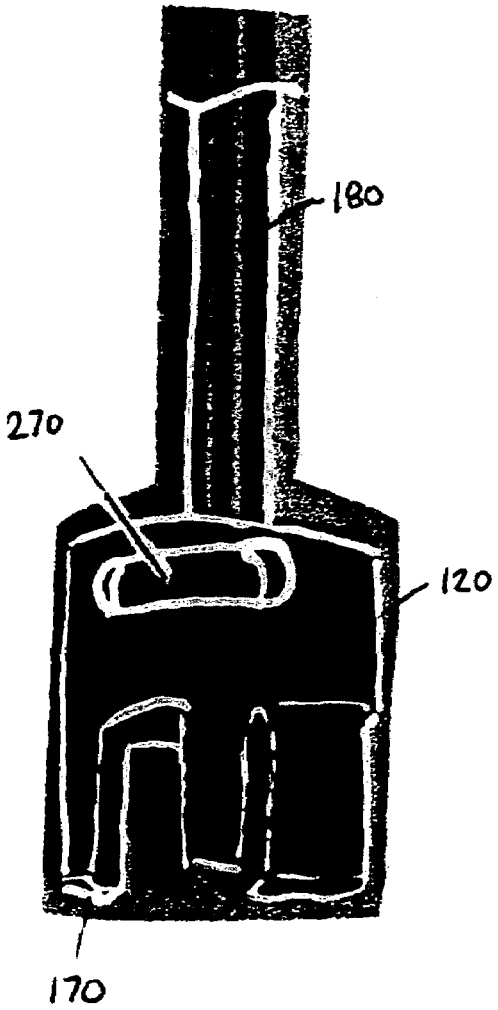
FIG. 4 is a windowed restrictor of the present invention.

Subsequently, when the controller 100 initiates reverse motion by the motor 110 to move the windowed restrictor 120 into the open position (See FIG. 2*b*). The current-consuming portion of the circuit is then shut down until a further signal is received from the controller 100. The motor 110 again acts as a brake until further power is applied (by shorting its coils together).

Use of a rotary motor powering the windowed restrictor in both directions also allows the system to be more responsive than solenoid systems, resulting in a faster data rate with more accurate or precise pulse-edge timing. Experimental results indicate that data rates of 0.25 seconds/pulse are possible with this system, as compared to 0.8 to 1.5 seconds/pulse in solenoid systems. Faster or modulated pulses may be obtained.

Flow Detection & Diagnostic Software

The controller 100 may be programmed to put the rotary pulser 10 in a dormant or power conserving state until a triggering event is detected. For example, the rotary pulser 10 may remain in the dormant or power conserving state until it senses a no flow-to-flow condition without rotation. This combination versus a flow state change with rotation instructs the rotary pulser 10 to create binary weighted flow restrictions, as programmed by the controller 100.

The controller 100 may detect the position of the windowed restrictor 120 against relative to a windowed restrictor stop 250. The windowed restrictor stop 250 may comprise a transverse slot 270 along a at least a portion of the perimeter of the windowed restrictor 120, the slot 270 corresponding generally to the working angle of rotation of the windowed restrictor 120 as it is movable between a restricted position and an open position. A pin 280 may extend from the fixed housing 140 to engage the slot 270.

The windowed restrictor stop 250 allows the controller 100 to sense when the windowed restrictor 120 open position and the windowed restrictor 120 restricted position. In addition, the controller 100 may be programmed to recognize that a certain number of rotations of the motor 110 are needed to move the windowed restrictor 120 between the open position and the restricted position. The controller may also sense rotation of the motor 110 and count rotations and direction of rotation.

Debris may enter the rotary pulser 10 with the mud, potentially causing jamming or other interference. The controller 100 may be programmed to detect and clear jams from the windowed restrictor 120 and/or the window 150 of the fixed housing 140 (e.g. any partial or complete obstruction of the flow passage 160). For example, debris may become lodged between the windowed restrictor 120 and the fixed housing 140, preventing the full opening or restricting of the flow passage 160. In such a situation, the controller 100 could detect an increase in current drawn by the motor 110 at an unexpected position of the windowed restrictor 120 (i.e. an increase in current would be expected when the windowed restrictor 120 is at the open position or the restricted position either end, as the windowed restrictor stop 250 is engaged, but would not be expected elsewhere in the working angle of rotation). This mid-travel increase in current draw may be recognized by the controller 100 as debris, and the controller 100 may then enter a clearing program to attempt to automatically clear the debris. In the clearing program, the windowed restrictor 120 may be reciprocated (e.g. slowly or quickly), or it may be repeatedly moved in an opening direction and moved in a closing direction, in order to "chew" on the debris until it is cut through. Due to the power of the motor 110 and the rotary gear reduction system 130, the windowed restrictor 120 is able to shear right through most types of debris commonly encountered.

The ability to detect and clear most jams within the tool allows a more robust design of the tool in other respects. For example, as the tool can easily clear particulate matter from the assembly, the tool can be provided with larger and fewer mud ports, and may include reduced amounts of screening. Screening is susceptible to clogging, and so reducing screening leads to longer mean time between operation failure of the device in-hole; and will reduce the velocity of any mud flow through the tool, reducing wear on the bladder and other parts. Further, the removal of several previously necessary components (such as the return spring, transformer, and solenoid and related electronics) contributes to a tool of smaller size (in both length and diameter) that is more versatile in a variety of situations. For example, embodiments with outside diameter less than 1⅜" (approaching 1") or length less than four feet have been achieved, although these dimensions are not by way of limitation, but by example only.

The rotary pulser 10 has generally been described in creating a positive pressure pulse, that is, moving the windowed restrictor 120 into the restricted position to create an increase in pressure. The rotary pulser 10 may also be used to create a negative pressure pulse, for example by moving the windowed restrictor 120 from the restricted position (or a partially restricted position) to the open position, to create a decrease in pressure. The rotary pulser 10 may also be used to create combinations of positive and negative pressure pulses.

Landing Sleeve (Muleshoe)

The rotary pulser 10 of the present invention may be received in a landing sleeve 260. The landing sleeve 260 may be compatible with both a vertical tool (or other "event trigger" type monitoring and reporting tools) and real-time MWD tools which allows the rotary pulser 10 of the present invention to be retrieved from the landing sleeve 260 and replaced in the landing sleeve 260 with a real-time MWD tool without having to trip the pipe out of the hole. This feature allows drilling with an event trigger type tool, such as a vertical tool, at a cost savings over the equipment and operations cost of a real-time MWD tool. In the event that the drilling operations run into unexpected circumstances (e.g. a vertical tool detects a vertical deviation outside the parameters and reports that deviation to surface via the rotary pulser 10), the event type trigger type tool can be retrieved from the landing sleeve 260 and a real-time MWD tool seated in the landing sleeve 260 to fully assess the situation and provide telemetry to surface, again via the rotary pulser 10, to allow correction, e.g. through directional drilling.

In addition, the rotary pulser 10 of the present invention is retrievable from the landing sleeve 260 and reseatable in the landing sleeve 260.

Custom software also has the ability to track downhole conditions, and also uses a sensor to detect mud flow. When mud flow is detected, a signal is sent to the Directional Module Unit (not shown), to activate the overall system. The system also has the ability to time stamp events such as start or end of mud flow, incomplete cycles or system errors, low voltages, current, and the like, as well as accumulated runtime, number of pulses, number of errors, running totals of rotations or motor pulses. Wires or conductors may also be easily passed by the pulser section to service additional near-bit sensors or other devices. The software that detects the mud flow can be configured for different time delays to enable it to operate under a larger variety of downhole drilling conditions than its predecessors. The mud flow detection capability can also be used to calibrate or confirm the open position and/or the closed position of the windowed restrictor 120.

In addition, a user may monitor such data as well as any downhole sensors using a user interface attachable to the tool. Such sensors may include pressure or temperature sensors, rotation step-counters, travel or depth sensors, current levels, battery voltage, or timers. The user could monitor each component of the actuator to determine when the tool must be removed from downhole for repair. A user may, in turn, program an activity to cause an action or correction in response to a sensed event.

The present invention has been described as being applicable to measurement while drilling (MWD) systems. As used herein, that includes, but is not limited to, any drilling or well servicing operations involving sending a signal from downhole to surface through the working fluid, and includes "triggering event" type monitoring tools (e.g. as a vertical tool monitoring declination and only reporting in the event of a triggering event, e.g. vertical angle outside of parameters) and includes "polling" type tools that can be polled to send back a reading (e.g. a vertical tool that monitors declination, but only reports to surface when sent a polling signal, such as no flow-to-flow condition without rotation, or at a polling time interval) and includes real-time MWD tools (e.g. that provide continuous or nearly continuous reporting of parameters to surface).

The above-described embodiments of the present invention are intended to be examples only. Alterations, modifications and variations may be effected to the particular embodiments by those of skill in the art without departing from the scope of the invention, which is defined solely by the claims appended hereto.

What is claimed is:

1. A downhole measurement-while-drilling rotary pulser comprising:

a windowed restrictor movable between an open position which permits mud flow through a fixed housing having a flow passage and a restricted position which restricts mud flow through the fixed housing having the flow passage, the windowed restrictor powered between the open position and the restricted position by a reversible electric motor, wherein the windowed restrictor is movable between the open position and the restricted position in a reciprocating rotary motion relative to the fixed housing, and wherein the fixed housing is held stationary and the windowed restrictor is rotatable, driven in rotation by the motor; and a controller to control the reversible electric motor and to sense the position of the windowed restrictor relative to the fixed housing, wherein the position of the windowed restrictor is adapted to be sensed when the mud flow through the flow passage is restricted, and wherein an amount and direction of rotations of the motor from the position are counted and stored by the controller, wherein the controller senses the position of the windowed restrictor by sensing whether movement of the windowed restrictor is impeded, wherein the controller counts a number of rotations of the motor until the windowed restrictor is impeded and compares the number of rotations to an expected number of rotations to determine the position of the windowed restrictor with respect to the fixed housing, and wherein the expected number of rotations is preset to allow a predetermined rate of mud flow past the windowed restrictor when the windowed restrictor is moved away from the fixed housing by the preset expected number of rotations and wherein the sensed position of the windowed restrictor is calibrated as a fully closed position of the windowed restrictor in controlling the windowed restrictor's travel during operation to avoid excess collision or frictional wear between the windowed restrictor and the windowed restrictor stop.

2. The rotary pulser of claim 1 wherein the controller includes a debris clearing command that is initiated when the number of rotations counted is not equal to the expected number of rotations.

3. The rotary pulser of claim 2 wherein the debris clearing command causes the motor to reciprocate the windowed restrictor to dislodge any debris present between the windowed restrictor and the fixed housing.

4. A method for causing the generation of a pressure pulse in drilling mud by a downhole measurement-while-drilling rotary pulser including a windowed restrictor movable between an open position which permits mud flow through a fixed housing having a flow passage and a restricted position which restricts mud flow through the fixed housing having the flow passage, the windowed restrictor powered between the open position and the restricted position by a reversible electric motor, and a controller to control the reversible electric motor and to sense the position of the windowed restrictor relative to the fixed housing, the method comprising:

powering, by the controller, the windowed restrictor movement by the reversible electric motor between the open position and the closed position while the fixed housing is held stationary wherein the windowed restrictor is movable between the open position and the restricted position in a reciprocating rotary motion relative to the fixed housing;

sensing, by the controller, a position of the windowed restrictor relative to the fixed housing with the controlled;

sensing, by the controller, the restricted mud flow through the flow passage of the fixed housing with the controller;

counting and storing the number and direction of the reversible electric motor's rotations from the closed position with the controller;

sensing, by the controller, whether movement of the windowed restrictor is impeded;

counting, by the controller, the number of rotations of the reversible electric motor, with the controller, until the windowed restrictor is impeded and comparing the number of rotations to an expected number of rotations to determine the position of the windowed restrictor with respect to the fixed housing;

presetting the expected number of rotations to allow a predetermined rate of mud flow past the windowed restrictor when the windowed restrictor is moved away from the fixed housing by the preset expected number of rotations; and calibrating the sensed position of the windowed restrictor as the fully closed position of the windowed restrictor in controlling the windowed restrictor's travel during operation to avoid excess collision or frictional wear between the windowed restrictor and the windowed restrictor stop.

5. A controller for use with a downhole measurement-while-drilling rotary pulser actuator, the controller deployed adjacent to or near the actuator on a bottom-hole assembly, the controller comprising:

a sensor that is a rotation-step counter, position sensor, current level sensor, timer, or error monitor, the sensor to provide an indication of whether a window in the rotary pulser is opened or closed;

a memory to store time-stamped or counted sensed events from the sensor together with an event-type indication;

control circuitry to cause an action within the actuator responsive to a sensed event, a time, an elapsed time, a series of sensed events, or any combination thereof to be recorded in the memory; and an operator interface to provide the time-stamped or counted sensed events together with the event-type indication from the memory to an operator.

* * * * *